US005566844A

United States Patent [19]

Bernardin

[11] Patent Number: 5,566,844

[45] Date of Patent: Oct. 22, 1996

[54] DISPLAY UNIT BACK WALL AND DISPLAY UNIT INCORPORATING SAME

[76] Inventor: Didier Bernardin, 60 Rue de Varenne, 75007 Paris, France

[21] Appl. No.: 290,496

[22] Filed: Aug. 15, 1994

[30] Foreign Application Priority Data

Aug. 16, 1993 [FR] France ..... 93 10007

[51] Int. Cl.[6] ..... A47B 43/00; A47B 47/00; A47B 57/00

[52] U.S. Cl. ..... 211/189; 277/193; 277/208; 277/162

[58] Field of Search ..... 211/94, 87, 189, 211/187, 162, 190, 206, 208, 193; 52/656.4, 731.5, 731.1, 731.9

[56] References Cited

U.S. PATENT DOCUMENTS

| | | | |
|---|---|---|---|
| 2,991,889 | 7/1961 | Levy et al. | 211/190 |
| 3,561,609 | 2/1971 | Doherty et al. | 211/206 |
| 3,835,354 | 7/1974 | Torres-Pena | 52/656.4 X |
| 3,924,373 | 12/1975 | Lizdas et al. | 52/656.4 X |
| 3,963,913 | 6/1976 | Donovan et al. | 240/2 AD |
| 3,971,477 | 7/1976 | Bruderly et al. | 211/190 X |
| 4,093,078 | 6/1978 | Radek | 211/189 |
| 4,286,719 | 9/1981 | Hall | 211/190 X |
| 4,323,163 | 4/1982 | Johns | 211/189 |
| 4,380,298 | 4/1983 | Harig | 211/190 X |
| 4,607,753 | 8/1986 | Radek | 211/94 X |
| 4,805,783 | 2/1989 | Mayer | 211/94 |
| 5,228,579 | 6/1993 | Kaufman | 211/94 |
| 5,255,803 | 10/1993 | Pavone et al. | 211/94 X |

FOREIGN PATENT DOCUMENTS

| | | |
|---|---|---|
| 0212996 | 3/1987 | European Pat. Off. . |
| 2525189 | 10/1983 | France . |
| 1303175 | 7/1971 | Germany . |
| 8813459 | 3/1989 | Germany . |

*Primary Examiner*—Alvin C. Chin-Shue
*Assistant Examiner*—Brian J. Hamilla
*Attorney, Agent, or Firm*—Young & Thompson

[57] ABSTRACT

A display unit back wall includes in a structure reinforced by stiffener bars two parallel uprights forming at least part of a slideway for a plurality of stacked slats, the two uprights forming the two lateral sides of a U-shape unitary construction frame. A crossmember is fixed to the bottom ends of the two uprights. The stiffener bars fixed to the uprights and to the crossmember are all within the peripheral edge of the frame. The U-shape unitary construction frame is made from channel-section, and each side of the slideway is formed between one of the two flanges of the upright and a facing side of the associated stiffener bar.

9 Claims, 3 Drawing Sheets

DISPLAY UNIT BACK WALL AND DISPLAY UNIT INCORPORATING SAME

BACKGROUND OF THE INVENTION

1. Field of the Invention

The present invention concerns a display unit back wall and a display unit incorporating this wall.

2. Description of the Prior Art

The present invention is more specifically concerned with a back wall made up of two parallel uprights which together form a slideway. A plurality of slats can be stacked between the uprights, at least some of them including accessory attachment means.

Product suspension rods, shelves and brackets can be attached to the resulting wall to constitute gondola (free-standing) or against the wall display units for use in supermarkets, for example.

To assemble the display unit a crossmember is required between the uprights to hold them parallel so that the slats can be slid between them.

Various embodiments of these crossmembers have been proposed for prior art devices.

Use of at least three parts, i.e. two uprights and one crossmember, wastes considerable time during assembly because of the need to connect the parts together.

Also, the type of crossmember used usually conditions how the back wall is used: in a display unit placed against a wall, as the back wall of a gondola or as the back wall of a gondola's upper part. If the use is changed it is necessary to dismantle the display unit and therefore the back wall.

U.S. Pat. No. 4,805,783 describes a display unit back wall comprising a one-piece U-shape frame with two channel-section uprights and a channel-section crossmember adapted to receive a plurality of slats coupled together beforehand.

A panel of this kind can be used for small panels but is not mechanically strong enough for large panels or for other applications such as backing walls for gondolas or other display units.

Document EP-A-0 212 996 describes a panel for exhibition use, etc associated with a frame comprising two tubular uprights joined together at the bottom by a horizontal crossmember. Another horizontal crossmember is removably attached to their upper ends. U-section members are attached to the inside of the uprights and the lower crossmember of the frame to form slideways adapted to receive a panel carrying on one or both sides a series of shaped members for fixing sundry accessories. The side tubes project some considerable distance beyond the slideways and increase the weight of the assembly whilst reducing the usable surface area relative to the overall dimensions.

An object of the present invention is to alleviate these drawbacks.

SUMMARY OF THE INVENTION

To this effect the invention proposes a display unit back wall including a U-shape unitary construction frame including two parallel upright sides forming at least part of a slideway for a plurality of stacked slats and a crossmember fixed to the bottom ends of the two uprights, stiffener bars fastened to the uprights and to the crossmember being all situated within a peripheral edge of the frame perpendicular to the general plane thereof.

The stiffener bars therefore lie against the back of the back wall, rather than the latter being between them, which represents a saving in weight and overall size and an increase in mechanical strength.

In a preferred embodiment of the invention each side of the slideway is formed between a flange on the upright and the facing side of the associated stiffener bar.

In accordance width another feature of the invention each upright includes parallel front and back flanges, the stiffener bars being fastened to the back flanges.

In one embodiment of the invention the uprights and the bottom crossmember are angle-irons and the stiffener bars are fixed to one flange of the angle-iron at a distance from and facing the other flange.

By virtue of these arrangements the display unit back wall is autonomous, of unitary construction and of simple design, for use as and where required.

The back wall is made up of a small number of parts and can be moved without any disassembly whatsoever.

The present invention also proposes a display unit including a display unit back wall including a U-shape unitary construction frame including two parallel uprights at the sides forming at least part of a slideway for a plurality of stacked slats and a crossmember fixed to the bottom ends of the two uprights, stiffener bars fastened to the uprights and to the crossmember being all situated within a peripheral edge of the frame perpendicular to the general plane thereof, two feet extending transversely to said back wall of said display unit, holes in median parts of the transverse cross-sections of said uprights, and feet including holes cooperating with those of said uprights adapted to be assembled to said uprights by removable fixing means using said holes.

Because of the holes in the median parts of the transverse cross-sections of the uprights of the back wall, a display unit can be assembled with the back wall having any of various possible heights.

Also, depending on the arrangement and the number of holes, it is a simple matter to assemble a display unit comprising various enclosure members as described hereinafter, as the latter can be simply attached to the unitary construction back wall as required.

The present invention will be better understood from the following description given by way of example and with reference to the appended drawings.

DETAILED DESCRIPTION OF THE PREFERRED EMBODIMENTS

Figure 1:
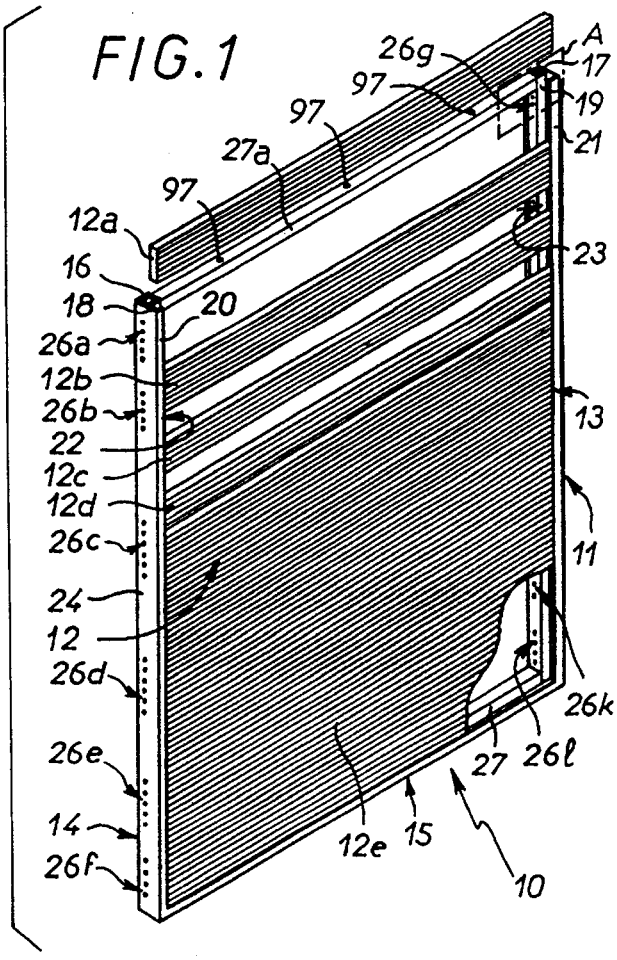
FIG. 1 is a partially cutaway elevation view of a preferred embodiment of display unit back wall of the invention.
Figure 2:
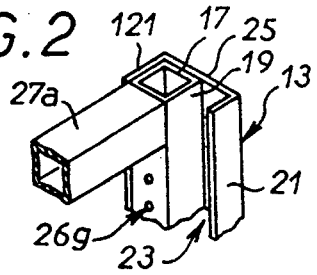
FIG. 2 shows the detail A from FIG. 1 to a larger scale.

FIGS. 1 and 2 show a display unit back wall 10. The back wall 10 Comprises, firstly, a frame 11 of unitary construction and, secondly, a plurality of slats 12, some of which (12*a*–12*d*) are shown during their insertion into the frame 11 and their addition to the stack 12*e* already formed.

The frame 11 is U-shape with the sides formed by two uprights 13, 14 joined together by a crossmember 15. These three parts are permanently fastened together. The uprights 13, 14 form the parallel sides of the frame 11. The cross-member 15 is perpendicular to and fastened to the bottom ends of the two uprights and forms the third side of the frame. The fastening is by welding or any other equivalent means, the uprights 13, 14 and the crossmember 15 being metal sections in this embodiment.

Figure 7:
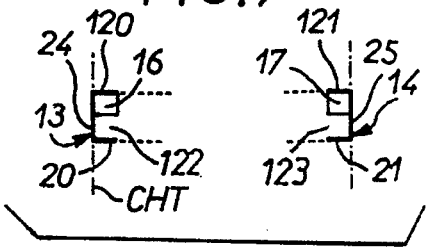
FIG. 7 is a diagrammatic top view of the frame of the back wall from FIGS. 1 through 6.

Each of the uprights 13, 14 and the crossmember 15 is a channel-section. The uprights 13, 14 at the sides each further include a longitudinal stiffener bar 16, 17 in the form of a square section tube extending all the way along the respective upright 13, 14 and welded to the latter in one corner of its U-shape transverse cross-section. The stiffener tube 16, 17 has its back against the inside of the back flange 120, 121 (see FIG. 7).

Accordingly, one side 18, 19 of the stiffener bar 16, 17 and one flange 20, 21 of the channel-section upright 13, 14 constitute two facing sides of one lateral edge 22, 23 of the slideway 122–123.

The slideway defined by one of these lateral edges 22, 23 on each side receives the plurality of slats 12 inserted between the uprights 13, 14 of the frame 11 and stacked on the crossmember 15. The plurality of slats 12 is held at the sides by the flanges 20, 21 of the uprights 13, 14, the sides 18, 19 of the stiffener tubes and the median parts 24, 25 of each of the uprights 13, 14.

The dimensions of the uprights 13, 14, the crossmember 15 and the stiffener bars 16, 17 and the distance between the uprights 13, 14 are naturally chosen to guide and hold the plurality of slats 12 effectively. The sides 18, 19 of the stiffener bars have the same transverse dimensions as the back flange 120, 121 against which their back lies. On the other hand, the front flange 20, 21 can have a smaller transverse dimension than the back flange.

Two transverse bars 27 and 27*a* in the form of tubes whose cross-section is identical to that of the stiffener bars 16, 17 fasten together the upper and lower ends of the latter between their facing sides. The bottom transverse stiffener bar 27 mates with the inside of the back flange 15B and the median part 15A of the crossmember 15. One side of the bottom transverse bar 27, the median part and one flange 15C of the channel-section crossmember 15 form extensions to the slideway 22–23 at their bottom ends.

The median parts 24, 25 of the uprights 13, 14 and the median part 15A of the crossmember 15 define the peripheral edge of the frame and its overall outside contour.

The resulting unitary construction U-shape frame 11 and the plurality of slats 12 can constitute an autonomous display unit back wall 10 which can be transported or placed on any appropriate support to constitute a display unit.

In accordance with the invention all the stiffener bars are inside the peripheral edge of the frame and therefore inside its overall contour. The overall contour CHT of the frame is shown in chain-dotted line in FIGS. 7 to 9. In the FIG. 7 embodiment the stiffener bars 16, 17, 27 have their back against the inside of the back flange 120, 121 of the channel-section uprights and crossmember 13, 14, 15. The median parts 24, 25 of the uprights and median part 15A of the crossmember 15 define the peripheral edge of the frame.

Figure 8:
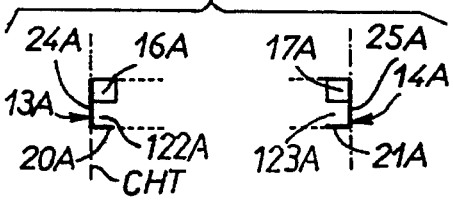
FIGS. 8 and 9 are views analogous to that of FIG. 7 showing two alternative embodiments of the frame.

In the FIG. 8 embodiment the uprights 13A, 14A and the crossmember (not shown) are angle-irons. The stiffener bars 16A, 17A are fastened to the lateral flange 24A, 25A at the dorsal end opposite the front flange 20A, 21A. Each side of the slideway 122A–123A is formed between the inside of the stiffener bar 16A, 17A and the inside of the front flange 20A, 21A. The lateral flanges A, 25A of the uprights and that of the crossmember are perpendicular to the general plane of the frame and define the peripheral edge thereof.

Figure 9:
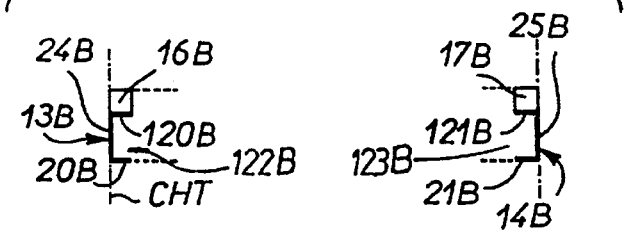

In the FIG. 9 embodiment the uprights 13B, 14B and the crossmember (not shown) are channel-sections. The stiffener bars 16B, 17B have their back against the outside of the back flange 120B, 121B. The slideway 122B–123B is formed between the flanges 20B, 120B and the flanges 21B, 121B. The median parts 24B, 25B of the uprights and the median part 15A of the crossmember 15 define the peripheral edge of the frame.

Other embodiments of the uprights and crossmembers can be adopted without departing from the scope of the invention. For example, the stiffener bars can be inserted between the back and intermediate flanges of an upright, the respective part of the slideway being formed between the front and intermediate flanges.

Note finally that the U-shape frame and the stiffener bars disposed within the peripheral edge of the frame constitute a lightweight unitary construction which is very strong and has a small overall size relative to its usable display area.

At least some of the plurality of slats 12 are provided with means for attaching accessories used to suspend or support objects to be displayed, as described below with reference to FIGS. 4, 5, 6*a* and 6*b*.

However, in accordance with a particularly advantageous feature of the preferred embodiment of the invention, the uprights 13, 14 include a plurality of holes 26*a*–26*f* and 26*g*, 26*k* and 26*l* disposed along the median parts 24, 25 of the transverse cross-sections of the uprights 13, 14 and forming regularly spaced groups.

These holes 26*a*–26*f* and 26*g*, 26*k* and 26*l* pass through the median parts 24, 25 and the stiffener tubes 16, 17.

Figure 3:
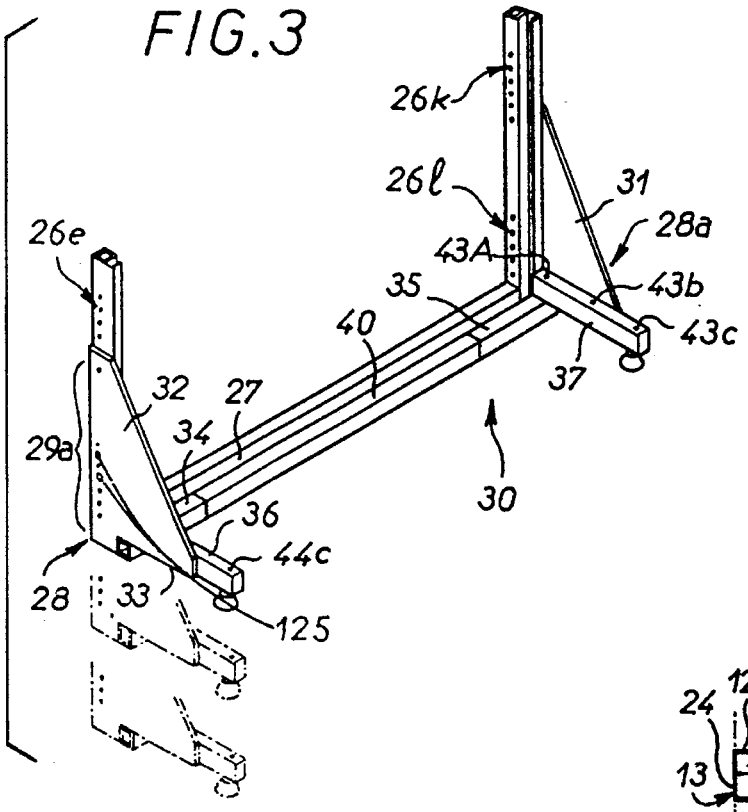
FIG. 3 shows part of a display unit incorporating the back wall from FIG. 1, with a diagrammatic representation of the height adjustment.
Figure 10:
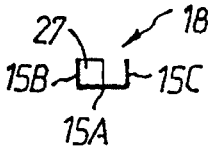
FIG. 10 is a diagrammatic section of view of the cross-member of FIGS. 3 an 5.

As shown in FIG. 3, it is then possible to attach to the U-shape unitary construction frame 11 two feet 28, 28*a* including holes 29*a*, 29*b* adapted to cooperate with those in the uprights 13, 14.

By virtue of removable fixing means (not shown), such as nuts and bolts, the feet 28, 28*a* can therefore each be fixed to one upright 13, 14 in such a way as to enable adjustment of the height of the display unit back wall 10.

The combination of the back wall 10 and the feet 28, 28*a* constitutes an autonomous display unit 30.

Note that in FIG. 3 the frame 11 is shown without some of the plurality of slats 12 and the height adjustment is indicated schematically by two positions of one of the feet 28, 28*a* shown in chain-dotted outline.

The feet 28, 28*a* each include a substantially right-angle triangle-shape plate 31, 32 in which one of the mutually perpendicular edges includes a recess 33 while the other is formed with holes 29*a*, 29*b*.

Into the corner of the recess 33 is fixed a section of square cross-section tube 34, 35 perpendicular to the plate 31, 32.

Another square cross-section tube 36, 37 with the ends closed is fixed to the tube sections 34, 35 and extends along the recess 33.

As also shown more particularly in FIG. 3, the feet 28, 28*a* carry locking screws 128 (only one shown) familiar to the person skilled in the art.

When the feet 28, 28*a* are attached by the edge of the plates 31, 32 including the holes 29*a*, 29*b* the tube sections 34, 35 extend along the crossmember 15 of the back wall 10 and receive a linking bar 40 with end parts 41 whose cross-section is complementary to the interior cross-section of the tube sections 34, 35 of the respective feet 28, 28*a*.

The linking bar 40 is used to hold the feet 28, 28*a* parallel to facilitate mounting of the frame 11 on the feet 28, 28*a* which are then substantially transversely disposed, in this example perpendicular, to the uprights 13, 14.

Figure 4:
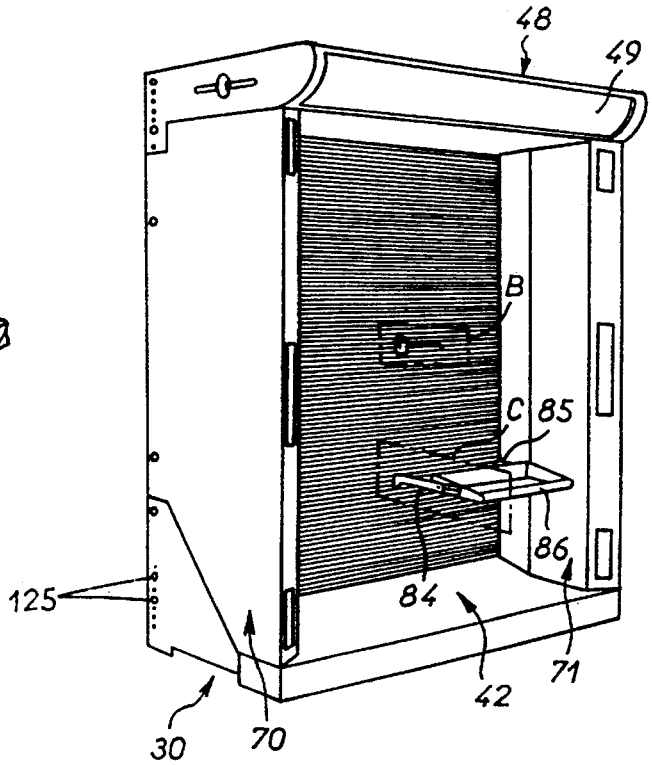
FIG. 4 is an elevation view of the display unit from FIG. 3 after various enclosure members have been fitted to it.
Figure 5:
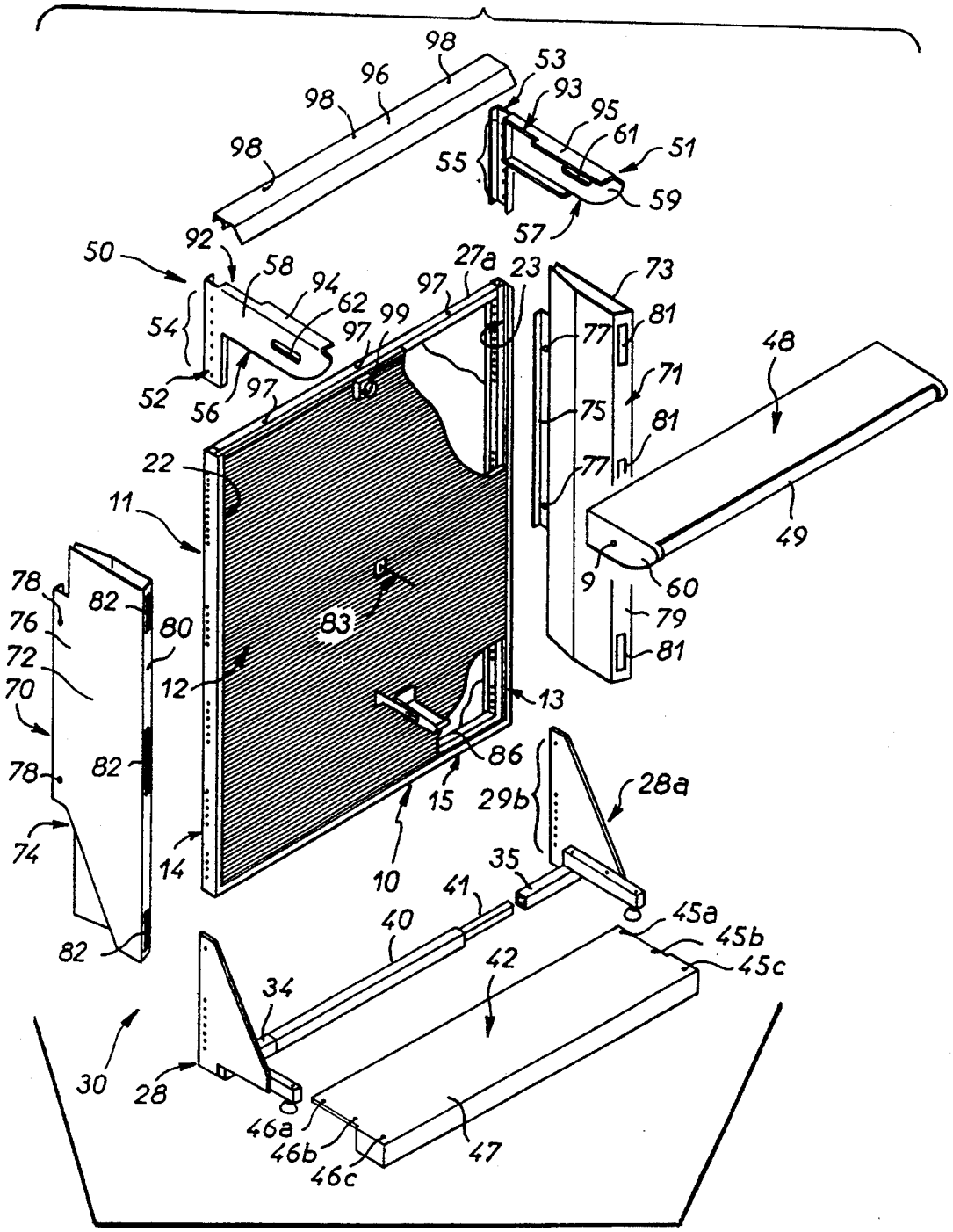
FIG. 5 is a partially cut away exploded view of the FIG. 4 display knit.

As shown in FIGS. 4 and 5, a box-section base 42 is removably fixed to the feet 28, 28*a* and between them.

To this end the closed end tubes 36, 37 include screwthreaded holes 43*a*–43*c*, 44*c* cooperating with screwholes 45*a*–45*c* and 46*a*–46*c* in the top plate 47 of the box-section base 42.

The box-section base 42 is shaped to fit between the feet 28, 28*a* and to accommodate the closed end tubes 36, 37.

A pediment 48 can be added to display unit 30.

In this embodiment the pediment 48 is generally parallelepiped-shape with a rounded front surface carrying a transparent plate 49. Means for illuminating advertising material carried by the plate 49 can therefore be disposed inside the pediment.

Note that the pediment 48 could instead include a bottom plate provided with means for fixing devices to illuminate the display unit (not shown here).

The pediment 48 is mounted on the back wall 10 by means of two L-shaped members 50, 51 in which each of the two branches is a channel-section. One of the branches 52, 53 is adapted to be fixed to an upright 13, 14 of the frame 11 and therefore includes holes 54, 55 for cooperating with the holes 26*a*, 26*g* of the respective upright 13, 14 to receive a nut and bolt (not shown). This allows the height of the pediment 48 to be adjusted.

The other branch 56, 57 is adapted to enclose the pediment 48 at the sides, the median part 58, 59 of the branch 56, 57 abutting the side wall 60 of the pediment 48.

To fix the pediment 48 to the L-shape members 50, 51 in a removable manner, the branches 56, 57 include oblong slots 61, 62 for a screw (not shown) cooperating with a screwthreaded hole 9 provided in each of the side walls 60 of the pediment 48.

The oblong slots 61, 62 enable depthwise adjustment of the pediment 48 On the display unit 30 by sliding on the channel-section branches 56, 57.

Note also that the free end of the branches 56, 57 with oblong slots is rounded in order to mate with the front profile of the pediment 48.

In accordance with another feature of the display unit 30 side walls 70, 71 of substantially trapezoidal cross-section form the junction between the box-section base 42 and the pediment 48.

The panel 72, 73 forming the larger base of the trapezium constitutes the outside of the wall 70, 71 and includes a recess 74 adapted to mate with the corresponding contour of the right-angle triangle-shape plate 31, 32 of the feet 28, 28*a* in order to form therewith a continuous outside surface.

The panel 72, 73 is extended by an L-shape profile section 75, 76 which has holes 77, 78 for removably attaching the side walls 70, 71 to the respective uprights 13, 14 by means of nuts and bolts (not shown).

The front panel 79, 80 of the side walls 70, 71 includes rectangular cut-outs 81, 82 for attaching to the latter transparent plates carrying advertising material, for example.

The interior of the side walls 70, 71 can be provided with illumination means.

Figure 6A:
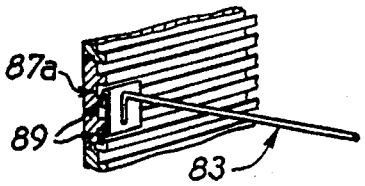
FIGS. 6*a* and 6*b* show the details B and C from FIG. 4 to a larger scale.
Figure 6B:
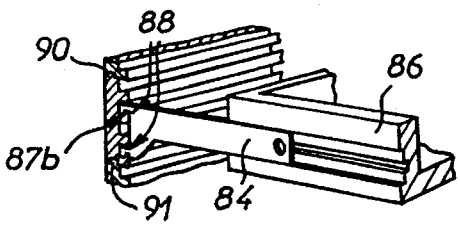

As shown in FIGS. 4, 6*a* and 6*b*, accessories for suspending or supporting objects to be displayed are hung on the back wall 10 of the display unit 30.

In this example these are a rod 83 for suspending objects and brackets 84, 85 carrying a tray 86 which can slide in and out.

To attach the accessories to the slats 12 the latter include attachment means as shown in FIGS. 6*a* and 6*b* having a substantially Y-shaped cross-section 87*a*, 87*b* forming a series of longitudinal hooks while the accessories 83, 84, 85 have at least one (in this example two) hook-shaped projections 88, 89 complementary to the attachment means 87*a*, 87*b*. In this embodiment the longitudinal hooks face upwards. The spacing of the longitudinal hooks and the projections is chosen according to whether the accessories are to be offered up to the slats from the side or from the front.

Note also that to ensure close contact between the slats 12 each has along its upper edge a longitudinal rib 90 and along its bottom edge a corresponding groove 91.

Slats of the kind described in document U.S. Pat. No. 4,805,783 can also be used.

Finally, referring again to FIG. 5, as the pediment 48 is shorter than the branches of the L-shape member receiving it, the latter have a recess 92, 93 in their top flanges 94, 95 to accommodate a panel 96 adapted to be removably fixed by nuts and bolts (not shown) to the top transverse bar 27*a* which for this purpose includes holes 97 cooperating with holes 98 in the panel 96.

The panel 96 can naturally be fixed directly to the back wall 10 and advantageously includes illumination means.

FIG. 5 also shows an electrical socket 99 mounted on one of the plurality of slats 12, in this example that at the upper end of the uprights 13, 14.

The display unit 30 as shown in FIG. 4 in particular can be placed against a wall.

Alternatively, if the back wall 10 is to be used in a gondola, i.e. to display items on both sides, feet extending to both sides of the wall can be removably attached to the latter while the slats 12 have substantially Y-shape cross-sections defining a series of hooks on both sides.

In this embodiment the feet can also have tube sections extending along the crossmember on one or both sides with a linking bar between the pair (or each pair) of sections.

The resulting display unit can have enclosure members added to it of the same type as already described.

The present invention therefore provides a display unit 30 of low-cost design, in particular by virtue of its enclosure members such as the side walls 70, 71 which are simply manufactured by cutting and bending metal plate.

Moreover, the feet 28, 28*a* and the unitary construction frame 11 constitute a display unit 30 which is stable and can be modified at will, especially adjusted in height.

In accordance with the invention, all that is required is to mount the unitary construction frame 11 on the feet 28, 28*a* held by the linking bar 40, the plurality of slats 12 being stacked into the frame 11 either before or after it is mounted on the feet 28, 28*a* to provide an instant display unit 30 which can then have various enclosure members added to it.

Further embodiments can be envisaged without departing from the scope of the present invention.

The linking bar 40 can be fixed by removable fixing means at its end 41 to the tube sections 34, 35 of the feet 28, 28*a*.

Other shapes of pediment, side walls or box-section base can also be designed as required and subject to adaptations that will be evident to the person skilled in the art.

For example, the front panel 79, 80 of the side walls 70, 71 can be replaced by a transparent plate held between two slideways, one of which is carried by the panel forming the outside of the side wall and the other by a panel removably fixed to the panel forming the inside of the side wall.

The enclosure members removably attached to the uprights 13, 14 of the unitary construction frame 11 can be attached by screws which are inserted into screwthreaded holes in the uprights 13, 14.

Of course, the present invention is not limited to the embodiments described and shown, other embodiments being feasible, in particular with respect to the stiffener bars which are square cross-section tubes here but can be rectangular or replaced by flat members welded to the uprights and to the crossmember.

What is claimed is:

1. A display unit comprising:

a display unit back wall having a U-shape unitary construction frame including two parallel uprights along a first and second side thereof, said uprights forming at least part of a slideway for a plurality of stacked slats, and a crossmember fixed to a bottom end of each of the two uprights along a third side of said frame, a plurality of stiffener bars fastened to the uprights and to the crossmember, said stiffener bars being all situated within a peripheral edge of the frame perpendicular to a general plane thereof, two feet extending transversely towards said back wall of said display unit, a plurality of holes in a median part of a transverse cross-section of each of said uprights, and said feet including a plurality of holes cooperating with the holes of said uprights and adapted to be assembled to said uprights by removable fixing means using said holes, each of said feet including at least one polygon-shaped cross-section tube section extending along the third side of said unitary contraction U-shaped frame towards the other foot and a linking bar having ends with a cross-section complementary to an inside cross-section of each of the tube sections of the respective feet being received by the tube sections.

2. A display unit according to claim 1, wherein said unitary construction U-shape frame is made from channel-section having two flanges, and each side of said slideway is formed between one of the two flanges of said upright and a facing side of the associated stiffener bar.

3. A display unit according to claim 1, wherein said unitary construction U-shaped frame is made from channel-section, said slideway is formed between parallel front and back flanges of said uprights and a back of each of said stiffener bars is against an outside of a corresponding one of the back flange of said uprights.

4. A display unit according to claim 1, wherein said unitary construction U-shape frame is made from channel-section, each side of said slideway is formed between two parallel flanges of said upright, and a back of each of said stiffener bars is against a corresponding one of the flanges of said upright.

5. A display unit according to claim 1, wherein said unitary construction U-shape frame is made from angle-irons having first and second flanges and said stiffener bar is fixed to the first flange of said upright at a distance from and facing the second flange of said upright.

6. A display unit according to claim 1, wherein another stiffener bar is fixed to an upper end of each of said stiffener bars attached to said uprights for providing additional stability to said uprights.

7. A display unit according to claim 1, wherein a box-section base is removably fixed to and between said feet.

8. A display unit according to claim 1, wherein two L-shape members having first and second channel-section branches are disposed one on each side of a pediment adjustable in depth along said first branches of said L-shape members and the second branches of said L-shape members include a plurality of holes adapted to cooperate with the corresponding holes in said uprights via removable fixing means for removably fixing each of said L-shape members to a respective upright of said unitary construction frame.

9. A display unit according to claim 8 wherein two sidewalls join a box-section base to said pediment and include a plurality of holes in an L-shape profile portion projecting from the side wall adapted to receive means for removably fixing a side wall to a respective upright of said unitary construction U-shape frame.

* * * * *